United States Patent [19]

Gueret

[11] Patent Number: 4,887,622

[45] Date of Patent: Dec. 19, 1989

[54] BRUSH FOR THE APPLICATION OF MASCARA TO THE EYELASHES

[75] Inventor: Jean-Louis Gueret, Paris, France

[73] Assignee: L'Oreal, Paris, France

[21] Appl. No.: 126,324

[22] Filed: Nov. 30, 1987

[30] Foreign Application Priority Data

Nov. 28, 1986 [FR] France ..... 86 16626

[51] Int. Cl.[4] ..... A46D 11/00

[52] U.S. Cl. ..... 132/320

[58] Field of Search ..... 132/320, 313, 316, 317; 15/159 A; 401/122

[56] References Cited

U.S. PATENT DOCUMENTS

| | | | |
|---|---|---|---|
| 4,387,479 | 6/1983 | Kigyos | 132/313 |
| 4,561,456 | 12/1985 | Guéret | 132/320 |
| 4,586,520 | 5/1986 | Brittain | 132/320 |
| 4,617,948 | 10/1986 | Guéret | 132/320 |

FOREIGN PATENT DOCUMENTS

| | | |
|---|---|---|
| 2146520 | 4/1985 | United Kingdom . |
| 2170996 | 8/1986 | United Kingdom . |

OTHER PUBLICATIONS

French Search Report, Aug. 1987.

*Primary Examiner*—Kenneth J. Dorner
*Assistant Examiner*—J. Hakomaki
*Attorney, Agent, or Firm*—Cushman, Darby & Cushman

[57] ABSTRACT

A brush, allowing a rapid and even application of mascara, as well as a proper separation of the lashes, comprises a central core 202 formed from a metallic twisted wire holding a helical array of radial bristles 203 disposed in a regular manner. The bristles 203 have a diameter of from 0.10 to 0.25 mm and the number of bristles 203, per turn is from approximately 10 to 40. The bristles, 203*a* of the free end of the brush 201 can be more densely arranged for making-up the lashes of the lower eyelid.

13 Claims, 1 Drawing Sheet

BRUSH FOR THE APPLICATION OF MASCARA TO THE EYELASHES

The present invention concerns a brush intended for the making up of the eyelashes by means of a lash-reinforcing product, also called mascara.

The usual brushes of this type, whose manufacture will be recalled below with reference to FIGS. 1 to 4 of the attached drawings, generally comprise tufts of relatively long bristles disposed in a spiral around a core or support constituted by a twisted iron wire.

Such brushes traditionally employ relatively supple bristles so as to give the brush an overall characteristic of appropriate suppleness, since when making up such a delicate base as the eyelashes the maximum diameter of the bristles is of the order of 0.08 millimeters. Moreover, the bristles which are disposed along a helix with a pitch of approximately 2 mm are placed in a substantially juxtaposed manner; in principle, there will be from 50 to 60 bristles per turn. It is apparent that this population density of the bristles is necessary, once the diameter of the bristles has been fixed at the value indicated above. The aim is, in effect, to make it possible to ensure that a sufficient quantity of mascara is taken up and that the lashes are correctly brushed at the time of application.

It is nevertheless apparent that in use, such brushes do not ensure a proper distribution of the make-up product on the lashes. In practice, the mascara is frequently found to be positioned in blobs without any homogeneity, so the user needs to effect repeated brushing actions until an even coating of the lashes is obtained.

This drawback is due to the fact that these brushes comprise a large number of bristles, producing an entanglement of the lashes, whereas on the contrary, it would be better to obtain a proper separation of the lashes at the time of brushing. Added to this difficulty is the fact that the mascara is already badly distributed over the brush when it is taken up. The reason for this is explained below.

It is known that a conventional mascara applicator comprises a mascara reservoir and a detachable cap which is intended to close the reservoir and which constitutes a handle allowing a brush to be manipulated carried by the end of a stem which is integral with the cap. In the closed position of the reservoir, the stem and the brush associated therewith penetrate into the reservoir. When the stem is withdrawn from the reservoir a certain quantity of mascara is taken up on the brush to be then applied on the lashes. Moreover the brush generally penetrates into the reservoir through a substantially circular opening surrounded by a flexible lip whose function is to exert a wiping action on the bristles of the brush with the object of eliminating the excess make up product taken up by the brush inside the reservoir. The diameter of this circular opening is smaller than the minimum diameter of the brush, measured at the tip of the bristles, so that the flexible lip surrounding the opening can exert its wiping action as the brush is being extracted from the reservoir.

However, it is this obligatory wiping action which leads to an uneven disposition of the mascara product on the bristles. Since these are in fact relatively dense and supple, the bristles of the turn which bend over in the direction of the core at the time when the helix turn passes through the wiping lip will go as far as producing the "bending over" of the bristles of the following turn, with the result that the make-up product has a tendency to accumulate in the region of the brush contiguous to the core. In these conditions, the user will have difficulties at the time of application in obtaining, with a single pass of the brush, a perfectly even and homogeneous coating of the lashes by the make-up product, since the lashes will have to pass progressively towards the ends of the bristles which initially carry only a small charge of the product. Moreover this passing is effected in a haphazard manner.

The present invention makes it possible to remedy these drawbacks.

The invention proposes for this purpose a two-fold modification of the characteristics of the bristles of the conventional brushes; on the one hand the bristles have a larger diameter, on average of the order of twice the diameter of the conventional such bristle, and on the other hand these bristles are interspaced at a far greater distance from each other by using a number of bristles which is approximately 35% to 80% less than that of a conventional mascara brush such as described above.

Accordingly the present invention provides a brush for the application of mascara to the eyelashes, comprising a central core formed from a twisted wire holding a helical array of regularly disposed bristles with a bristle diameter of from 0.10 to 0.25 mm and with from approximately 10 to 40 bristles per turn of the helix.

The use of more thinned out and harder bristles produces a brush which is harder to the touch, but which nevertheless does not give an impression of hardness when used. Such a brush facilitates, on the one hand, a perfect separation of the lashes from each other since the combing of the lashes is obtained without difficulty because of the greater firmness of the bristles and, on the other hand, a rapid and even application of the make-up product because the bristles of the brush are found to be uniformly coated from their bases up to their tips.

In fact, the above-mentioned drawback of the "flattening" of one turn by the preceding turn upon passing the wiper lip, producing in its turn the "flattening" of the make-up product against the core, is eliminated in the case of the brush according to the invention; in this case, because of being relatively sparse, the bristles of one turn cannot, by bending over as they pass through the wiper lip, also produce the bending over of the bristles of the following turn; on the contrary, they interpenetrate between the bristles of this following turn which thus remains in its normal position until just before itself passing through the wiper lip. It follows from this that when the bristles of one turn return to their normal position on emerging from the wiper lip, they are found to be evenly coated with mascara from their bases as far as their tips and thus the fouling and dragging of the stem of the brush upon passing through the wiper device is prevented.

Thus, at the time of application, the desired result is immediately obtained, especially as the brushing of the lashes is itself also effected efficiently as a result of the hardness of the bristles.

This action can be improved still further if the bristles of the brush comprise capillary channels extending over the whole length of the bristle. In these conditions, the product to be applied to disposed evenly and homogeneously in the capillary channels which thus constitute a reservoir from which the make-up product can be distributed by flowing uniformly over the lashes. It follows that an even and homogeneous application on the lashes can be obtained in practically only one pass.

The choice of these bristles with at least one capillary channel allows, moreover, each bristle to be charged with a larger quantity of the product and it has become evident in use that with such brushes a make-up of a new nature is possible, procuring an aesthetic effect which had not been available so far.

In accordance with a variant it is also possible to retain a greater bristle population density for the bristles situated in the vicinity of the free end of the brush, to allow this portion of the brush to be used for making-up the small lashes of the bottom eyelid.

This two-fold modification of the characteristics of the bristles of the brush relative to the bristles of a conventional mascara brush is obligatory for attaining the desired result; in fact, the population density of the bristles is reduced without increasing their diameter, the brush would have been too soft and the density of the product on each bristle too low and neither the combing nor the distribution of a relatively large quantity of mascara on the lashes could have been obtained in the good conditions obtained with the brush according to the invention.

The present invention has for one object the provision of a new industrial product which comprises a brush for the application of mascara on eyelashes and which includes a central core formed by a twisted iron wire holding a helical array of radial bristles in a regular manner characterized by the fact that the bristles have a diameter between 0.10 and 0.25 mm, the number of bristles per turn being between 10 and 40, approximately.

Preferably, the bristles of the brush according to the invention have a diameter of approximately 0.17 mm; the wire of the core has a diameter of from 0.45 to 0.75 mm; the pitch of the helix of the bristles of the brush is comprised from 1 to 2 mm.

Moreover, in a preferred embodiment, the number of bristles per turn is of the order of 12 to 15. This corresponds to a population density of bristles which is 75% less than that of a conventional mascara brush.

Moreover, it is particularly preferred that in the free end region of the brush, the number of bristles per turn is modified to be from 8 to 50, that is to say to regain a density corresponding to a disposition of the bristles contiguous to each other. The number of turns whose bristle propulation density is thus increased may advantageously be from three to five. This disposition makes it possible to make up more easily the small lashes situated on the bottom eyelid.

Moreover it is advantageous for each bristle of at least some of the bristles of the brush, preferably all of them, to comprise on its surface at least one capillary channel extending substantially from its base as far as its tip. The median line of such a capillary channel formed on the surface of a bristle is in particular a straight line parallel to the axis of the bristle. This disposition makes it possible to take up much more evenly and in larger quantities the mascara on the brush which comes to be situated in the reservoirs constituted by the capillary channels. On application, the mascara can then flow evenly; such an advantage is added to the advantage already obtained by the combination of the relatively larger diameter bristles with a sparser disposition than in the case of conventional brushes. Moreover, depending on the choice of material constituting the bristle, the presence of the channels makes it to a certain extent possible to soften a bristle which otherwise could have been judged to be too rigid. In effect, when the bristles are implanted between the turns of the core, there is a softening of the bristles due to the deformation of the cross-section of the bristle, which is all the more noticeable when bristles used comprise capillary tubes.

In the case of bristles provided with such capillary channels, the number of these channels per bristle can be as much as five; these channels, when two or more are provided, are preferably regularly distributed at the periphery of the bristle in the case where their number exceeds two. In accordance with a particularly preferred embodiment, bristles used have a cruciform cross-section.

Moreover, each such channel advantageously has a generally V-shaped or U-shaped cross-section, with the sides of the V or U converging slightly outwardly near their free ends before again diverging in the zone where the capillary channel opens out at the surface of the bristle.

Advantageously, such capillary channels have a depth of from 0.02 to 0.06 mm and a largest width of from 0.02 to 0.06 mm.

The materials chosen for the bristles are for instance, nylon-6.6 or nylon-6.10, in particular nylon-6.6 which softens with time by progressively absorbing the moisture from the atmosphere. The filaments constituting the bristles are advantageously produced by the extrusion of the plastic material of which they are made.

In order that the present invention may more readily be understood, a manufacturing process of a conventional eyelash brush will be described below with reference to the attached drawings, and then the necessary modification of this process to obtain a brush according to the invention, as well as a variant thereof, will be described subsequently.

In these drawings:

FIGS. 1 and 2 represent a metallic wire constituting the core of the brush in two intermediate forms which it has during manufacture;

FIGS. 3 and 4, respectively, represent a profile and top view of a rake delivering the bristle tufts intended, in conjunction with the core, to constitute the brush;

Figure 1:
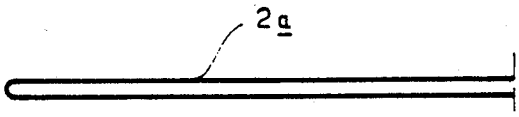
Figure 2:
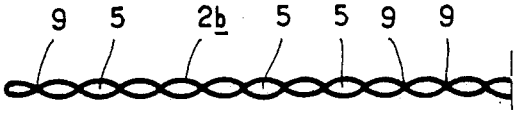
Figure 3:
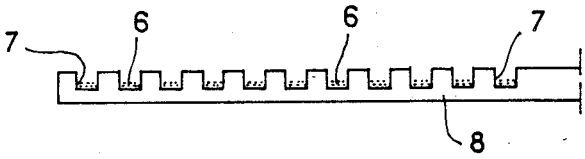
Figure 4:
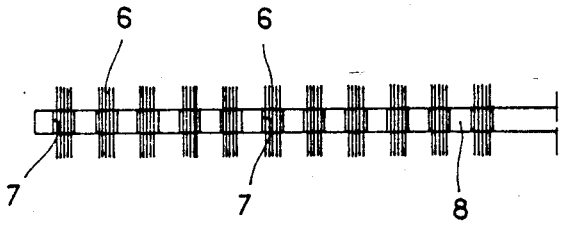
Figure 5:
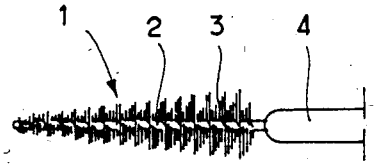
FIG. 5 is a profile view of a conventional mascara brush.

Reference to FIG. 5 will show that 1 designates a conventional make-up brush for eyelashes as a whole. This brush 1 is constituted by a central core 2 at whose periphery are implanted the bristles 3; the core 2 is constituted by a twisted iron wire with a diameter of 0.75 mm holding a helical array of radial bristles. The core 2 is joined to the stem 4 of a conventional applicator device. The brush 1 is inscribed as a whole in a cone frustum tapering towards the free end of the brush.

FIGS. 1 to 4 illustrate the various manufacturing stages of such a brush. The first stage involves folding an iron wire 2*a* (FIG. 1) back on itself, in the manner of a hairpin; the second stage involves twisting the folded back wire 2*a* of FIG. 1, the twisted form 2*b* obtained, represented in FIG. 2, being such that there is a succession of substantially regular loop openings 5.

The bristles 3 are disposed in regular bundles 6 within successive mutually parallel teeth 7 of a rake-shaped device 8 from which they project laterally by substantially the same distance on either side. The distance between two successive points 9 separating two loops 5 of the twisted wire 2*b* corresponds to the pitch of the rake-like device 8.

With the bristle bundles 6 thus disposed, the rake-like device 8 is brought near the twisted wire 2*b* until the bundles 6 each penetrate with one of their ends into a loop 5 perpendicular to the median line of the twisted wire 2*b* until the wire comes to occupy a median position in relation to the bundles 6 of the bristles which then project from the latter on either side by a practically identical distance.

At that moment, the twisting movement, already effected to constitute the twisted wire 2*b*, is continued so that the pitch of the wire becomes progressively smaller, the two iron wire strands becoming contiguous and the bundles 6 of the bristles being simultaneously deformed to lead to the above-mentioned spiral form whose pitch is of the order of 2 mm.

To obtain the bristles 3, polyamide filaments are used with a diameter of approximately 0.8 mm. The number of bristles constituting one bundle 6 is the order of sixty. Thus, the brush represented in FIG. 5 has a helical array of bristles relatively tightly placed against each other.

Figure 6:
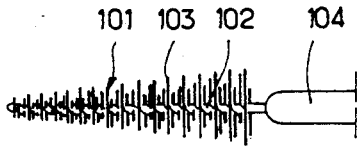
FIG. 6 is a view, similar to FIG. 5, of a mascara brush in accordance with the present invention.

To obtain the brush 1 represented in FIG. 6, which conforms to the present invention, the above indicated method is used except that the depth of each tooth of the rake-like device 8 for dispensing the bundles 6 of the bristles is halved and that, moreover, the bristles 3 have a diameter of approximately 0.17 mm. It follows from this that the number of bristles per turn of the brush 101 of FIG. 6 is 15; it has therefore been reduced by 75%, the reduction by half of the overall volume of the bristles being combined with a reduction by half due to the doubling of the diameter of the bristles.

Figure 7:
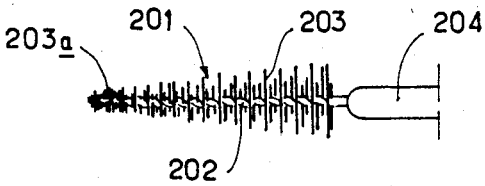
FIG. 7 is a view, similar to FIG. 6, of a variant of a mascara brush according to the invention.

FIG. 7 shows a variant (201) of the brush 101 of FIG. 6, the brush 201 in accordance with this variant having the special feature that the four last turns at the free end of this brush comprise bristles 203*a* of the same diameter as the bristles 203 of the remainder of the brush, but with a higher population density corresponding to a substantially contiguous disposition of the bristles, in particular by keeping the conventional depth of the teeth of the rake-like device 8 for these turns. The number of bristles per turn is 30. This specific characteristic of the brush 201 makes it possible to make-up more appropriately the small lashes of the lower eyelid which require more accurate making up.

Figure 8:
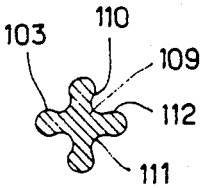
FIG. 8 represents, on a greatly enlarged scale, a bristle of the brush according to a preferred embodiment of the present invention.

Moreover, the bristles of the brushes 101 and 201 have the special feature of having a cruciform cross-section, as shown in FIG. 8. The bristle 103 represented in this Figure comprises an external cylindrical shell in whose surface have been formed four regularly distributed identical longitudinal channels 109 each with its axis parallel to that of the bristle 103.

Each channel 109 has a V-shaped cross-section whose facing sides 110 form an angle which is slightly less than 90°. The sides 110 are joined along a rounded furrow bottom 111. Moreover, near their free edges, each side 110 has a slight swelling 112 so they converge before opening out to the outside of the bristle 103.

The depth of the channels 109, measured along a diameter of the bristle 103, is of the order of 0.03 millimeters. Four reservoirs are thus constituted along each bristle 103 for the make-up product to be trapped by capillarity when the mascara is taken out of the main reservoir.

In this way, the brush 101, which can be seen to be charged with the make-up product from the bottom of the bristles up to their tip, can take up a make-up product in a larger quantity than if these bristles had a circular cross-section; at the time of application of the make-up, the capillary reservoirs are progressively emptied, leading in a single pass to a homogeneous and heavy coating of the lashes by the product, obtaining the new aesthetic effect observed with the brushes of the invention.

It can also be stressed that with bristles of a cruciform cross-section it is possible, to a certain extent, to reduce the overall hardness of the brush, in particular in the case where the material chosen for the bristles could be relatively rigid. Nylon-6.6 or Nylon 6.10 can, in fact, be the material for the bristles of the brush; the first of these has the property of absorbing much more of the atmospheric humidity than does Nylon-6.10 and therefore of softening with time.

I claim:

1. A brush for the application of mascara to the eyelashes, comprising a central core formed from a twisted wire holding a helical array of regularly disposed bristles with a bristle diameter of from 0.10 to 0.25 mm and with from approximately 10 to 40 bristles per turn of the helix.

2. A brush according to claim 1, wherein the wire of the core has a diameter of from 0.45 to 0.75 mm, and the pitch of the helix is from 1 to 2 mm.

3. A brush according to either of claims 1 or 2, wherein the bristles have a diameter of substantially 0.17 mm.

4. A brush according to claims 1 or 2, wherein there are substantially 15 bristles per turn.

5. A brush according to claims 1 or 2 wherein, in the vicinity of the free end of the brush, the number of bristles per turn is modified to be from 8 to 50.

6. A brush according to claim 5, wherein there are from three to five turns whose bristle density is thus modified.

7. A brush according to claims 1 or 6, wherein each bristle of at least part of the set of bristles of the brush comprises on its surface at least one capillary channel extending substantially from its base as far as its tip.

8. A brush according to claim 7, wherein the median line of a said capillary channel at the surface of a bristle is a straight line parallel to the axis of the bristle.

9. A brush according to either of claim 7 wherein there are no more than five such capillary channels possessed by one bristle.

10. A brush according to claim 9, wherein there are at least two of the capillary channels and they are regularly distributed at the periphery of the bristle.

11. A brush according to claim 7, wherein each capillary channel has a generally V-shaped or U-shaped cross-section, the sides of the U or of the V converging slightly near their free ends before again diverging in the zone where the capillary channel opens out at the surface of the bristle, and wherein each channel has a depth of from 0.02 to 0.06 millimeters and a greatest width of from 0.02 to 0.06 millimeters.

12. A brush according to claim 11, wherein the bristles have been formed by the extrusion of a plastic material.

13. A brush according to claim 12, wherein the plastic material is Nylon-6.6 or Nylon-6.10.

* * * * *

US004887622B1

REEXAMINATION CERTIFICATE (3597th)

United States Patent [19]

Gueret

[11] B1 4,887,622

[45] Certificate Issued Aug. 11, 1998

[54] BRUSH FOR THE APPLICATION OF MASCARA TO THE EYELASHES

[75] Inventor: Jean-Louis Gueret, Paris, France

[73] Assignee: L'Oreal, Paris, France

Reexamination Requests:

No. 90/004,135, Feb. 12, 1996
No. 90/004,284, Jun. 17, 1996
No. 90/004,678, Jun. 26, 1997

Reexamination Certificate for:

Patent No.: 4,887,622
Issued: Dec. 19, 1989
Appl. No.: 126,324
Filed: Nov. 30, 1987

[30] Foreign Application Priority Data

Nov. 28, 1986 [FR] France ..... 86 16626

[51] Int. Cl.[6] ..... A45D 40/26
[52] U.S. Cl. ..... 132/320; 132/218
[58] Field of Search ..... 132/218, 313, 132/317, 320

[56] References Cited

U.S. PATENT DOCUMENTS

| | | | |
|---|---|---|---|
| 2,580,378 | 12/1951 | Peterson et al. | 300/21 |
| 3,124,823 | 3/1964 | Charvat | 15/206 |
| 3,186,018 | 6/1965 | Shaw | 15/159 |
| 3,238,553 | 3/1966 | Bailey et al. | 15/159 |
| 3,344,457 | 10/1967 | Grobert | 15/159 |
| 3,908,676 | 9/1975 | Levine et al. . | |
| 3,921,650 | 11/1975 | Montgomery . | |
| 4,381,325 | 4/1983 | Masuda et al. | 428/91 |
| 4,446,880 | 5/1984 | Gueret et al. . | |
| 4,461,312 | 7/1984 | Gueret . | |
| 4,470,425 | 9/1984 | Gueret . | |
| 4,545,393 | 10/1985 | Gueret et al. . | |
| 4,561,456 | 12/1985 | Gueret . | |
| 4,586,520 | 5/1986 | Brittain . | |
| 4,617,948 | 10/1986 | Gueret . | |
| 4,632,136 | 12/1986 | Kingsford . | |
| 4,662,385 | 5/1987 | Schefer | 132/88.5 |
| 4,733,425 | 3/1988 | Hartel et al. | 15/206 |
| 4,861,179 | 8/1989 | Schrepf et al. | 401/129 |

FOREIGN PATENT DOCUMENTS

| | | |
|---|---|---|
| 0038524 | 4/1981 | European Pat. Off. . |
| 50-37221 | 12/1975 | Japan . |
| 56-37907 | 9/1979 | Japan . |
| 61-106781 | 3/1983 | Japan . |
| 59-1312 | 1/1984 | Japan . |
| 2170996 | 8/1986 | United Kingdom . |

OTHER PUBLICATIONS

*Webster's Unabridged Dictionary, Second Edition* (1943) pp. 1157, 1158, 2428.
*McGraw–Hill Dictionary of Scientific and Technical Terms, Third Edition* (1984) p. 737.

*Primary Examiner*—Todd E. Manahan

[57] ABSTRACT

A brush, allowing a rapid and even application of mascara, as well as a proper separation of the lashes, comprises a central core 202 formed from a metallic twisted wire holding a helical array of radial bristles 203 disposed in a regular manner. The bristles 203 have a diameter of from 0.10 to 0.25 mm and the number of bristles 203, per turn is from approximately 10 to 40. The bristles, 203a of the free end of the brush 201 can be more densely arranged for making-up the lashes of the lower eyelid.

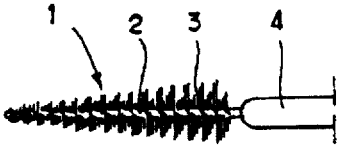

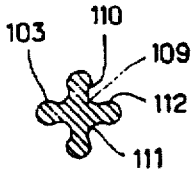

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–13 is confirmed.

New claims 14–17 are added and determined to be patentable.

*14. A brush according to claim 1, wherein the wire of the core has a diameter of from 0.45 to 0.75 mm.*

*15. A brush according to claim 1, wherein the pitch of the helix is from 1 to 2 mm.*

*16. A brush according to claim 1, wherein the bristles have a diameter larger than 0.10 mm.*

*17. In a mascara applicator including a mascara reservoir, a detachable cap adapted to close said reservoir, a stem integral with said cap and a brush depending therefrom, said stem and brush penetrating into said reservoir through a substantially circular opening surrounded by a wiping lip, the improvement which comprises said brush comprising a central core formed from a twisted wire holding a helical array of regularly disposed bristles with a bristle diameter of from 0.10 to 0.25 mm and with from approximately 10 to 40 bristles per turn of the helix.*

* * * * *